US010955766B2

(12) United States Patent
Imai et al.

(10) Patent No.: US 10,955,766 B2
(45) Date of Patent: Mar. 23, 2021

(54) IMAGE FORMING APPARATUS INCLUDING OPTICAL SCANNING APPARATUS

(71) Applicant: CANON KABUSHIKI KAISHA, Tokyo (JP)

(72) Inventors: Yuichiro Imai, Tokyo (JP); Yasuaki Otoguro, Abiko (JP); Yuta Okada, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/890,399

(22) Filed: Jun. 2, 2020

(65) Prior Publication Data

US 2020/0387080 A1 Dec. 10, 2020

(30) Foreign Application Priority Data

Jun. 7, 2019 (JP) ..... JP2019-107373

(51) Int. Cl.

| | |
|---|---|
| ***G03G 15/04*** | (2006.01) |
| ***G03G 21/00*** | (2006.01) |
| ***G03G 15/00*** | (2006.01) |
| ***G03G 21/16*** | (2006.01) |

(52) U.S. Cl.

CPC . *G03G 15/04036* (2013.01); *G03G 15/04072* (2013.01); *G03G 15/80* (2013.01); *G03G 21/1652* (2013.01); *G03G 21/1666* (2013.01); *G03G 2221/166* (2013.01); *G03G 2221/1636* (2013.01)

(58) Field of Classification Search

CPC ..... G03G 15/04036; G03G 15/04072; G03G 15/80; G03G 21/1652; G03G 21/1666; G03G 2215/0404; G03G 2221/1636; G03G 2221/166

USPC ..... 399/88, 90, 118; 347/138, 245, 257, 263

See application file for complete search history.

(56) References Cited

U.S. PATENT DOCUMENTS

| | | | | |
|---|---|---|---|---|
| 5,495,281 | A * | 2/1996 | Nashida | B41J 2/471 347/224 |
| 8,411,122 | B2 * | 4/2013 | Sakita | G02B 26/127 347/236 |
| 8,564,868 | B2 * | 10/2013 | Kusuda | B41J 29/02 359/196.1 |
| 10,147,532 | B2 * | 12/2018 | Onishi | H04N 1/0083 |
| 10,739,720 | B2 * | 8/2020 | Kondo | G03G 15/04054 |
| 2015/0212477 | A1 * | 7/2015 | Ishidate | G03G 15/80 347/118 |
| 2015/0309439 | A1 * | 10/2015 | Masuda | G03G 21/1666 399/177 |
| 2016/0207328 | A1 * | 7/2016 | Otoguro | G03G 15/04072 |

(Continued)

FOREIGN PATENT DOCUMENTS

| | | | |
|---|---|---|---|
| JP | 10024621 | A * | 1/1998 |
| JP | 2002-287063 | A | 10/2002 |
| JP | 2004145181 | A * | 5/2004 |

(Continued)

*Primary Examiner* — Robert B Beatty

(74) *Attorney, Agent, or Firm* — Canon U.S.A., Inc. IP Division

(57) ABSTRACT

An arrangement is therefore employed in which a flexible flat cable is guided by a guide member situated at a position facing a metal rear plate and the flexible flat cable extending from a connector to the metal rear plate is brought into contact with a wall portion of the metal rear plate so that the flexible flat cable is grounded.

11 Claims, 8 Drawing Sheets

(56) References Cited

U.S. PATENT DOCUMENTS

2017/0299974 A1* 10/2017 Kawano ..... G03G 21/1652

FOREIGN PATENT DOCUMENTS

JP 2012144019 A * 8/2012 ..... G03G 21/1853
JP 2012-247510 A 12/2012

* cited by examiner

IMAGE FORMING APPARATUS INCLUDING OPTICAL SCANNING APPARATUS

BACKGROUND OF THE DISCLOSURE

Field of the Disclosure

The present disclosure relates to image forming apparatuses, such as copying machines and printers, that form an image on a recording sheet using an electrophotographic method.

Description of the Related Art

There is an electrophotographic image forming apparatus with an optical scanning apparatus that emits laser light to a charged surface of a photosensitive drum to form an electrostatic latent image on the photosensitive drum. The optical scanning apparatus includes a light source, optical system components, such as a rotary polygon mirror that deflects a light beam emitted from the light source, a mirror, and a lens, and an optical box that is a housing to cover the optical system components.

The optical scanning apparatus is controlled by a control unit of the image forming apparatus. A control signal for controlling the optical scanning apparatus is transmitted from the control unit to the optical scanning apparatus through a flexible flat cable (FFC). The flexible flat cable includes a plurality of conductive lines. The conductive lines emit electromagnetic wave noise. The electromagnetic wave noise can cause driving of the image forming apparatus to become unstable to lead to poor image forming. For example, Japanese Patent Application Laid-Open No. 2012-247510 discusses a cable that is connected to a substrate on a side wall of an optical scanning apparatus. A control signal is transmitted from a main body apparatus to the optical scanning apparatus through the cable.

In some image forming apparatuses, an optical scanning apparatus is situated to face a rear plate that constitutes a portion of a housing of a main body of the image forming apparatus. For example, Japanese Patent Application Laid-Open No. 2002-287063 discusses a structure in which a front side of an optical scanning apparatus is screwed to a front plate and a back surface side is fixed to a rear plate via a plate spring. With this structure, the optical scanning apparatus is maintained in a state of being fixed to a housing of a main body of an image forming apparatus at a position facing the rear plate.

In some image forming apparatuses, a metal rear plate in a grounded state is situated on a back surface side of a main body of the image forming apparatus. In a case where an optical scanning apparatus is attached to an apparatus body at a position facing a rear plate, a flexible flat cable extending from the optical scanning apparatus toward a control unit is sometimes arranged near the rear plate.

However, even with this structure, the rear plate and the flexible flat cable are not maintained in a state of being reliably in contact with each other. Thus, electromagnetic wave noise can be emitted from the flexible flat cable and causes poor image forming.

SUMMARY OF THE DISCLOSURE

According to an aspect of the present disclosure, an image forming apparatus includes a metal rear plate on a back surface side of the image forming apparatus and grounded, a photosensitive drum, an optical box attached to a position facing the rear plate through an opening of a side surface of the image forming apparatus, the optical box including a substrate that includes a connector and a light source configured to emit a light beam to which the photosensitive drum is exposed, a flexible flat cable connected to the connector and configured to transmit a signal to drive the substrate, and a guide member configured to curve the flexible flat cable toward the side surface and guide the flexible flat cable toward the side surface along a wall portion of the rear plate that faces the optical box in a front-rear direction, the flexible flat cable extending from the connector toward the wall portion, and the guide member being on the wall portion, wherein a first virtual line is defined as a perpendicular line from the connector to the wall portion and a second virtual line is defined as a perpendicular line from the guide member to the first virtual line, and wherein a distance from a connection portion of the flexible flat cable that is connected to the connector to a portion of the flexible flat cable that is guided by the guide member is longer than a sum of a length of the first virtual line and a length of the second virtual line, and the flexible flat cable guided by the guide member is in contact with the wall portion.

Further features and aspects of the present disclosure will become apparent from the following description of example embodiments with reference to the attached drawings.

DESCRIPTION OF THE EMBODIMENTS

An example embodiment of the present disclosure will be described below with reference to the drawings. Unless otherwise specified, sizes, materials, shapes, and relative positions of below-described components are not intended to limit the scope of the disclosure thereto.

(Example Image Forming Apparatus)

Figure 1:
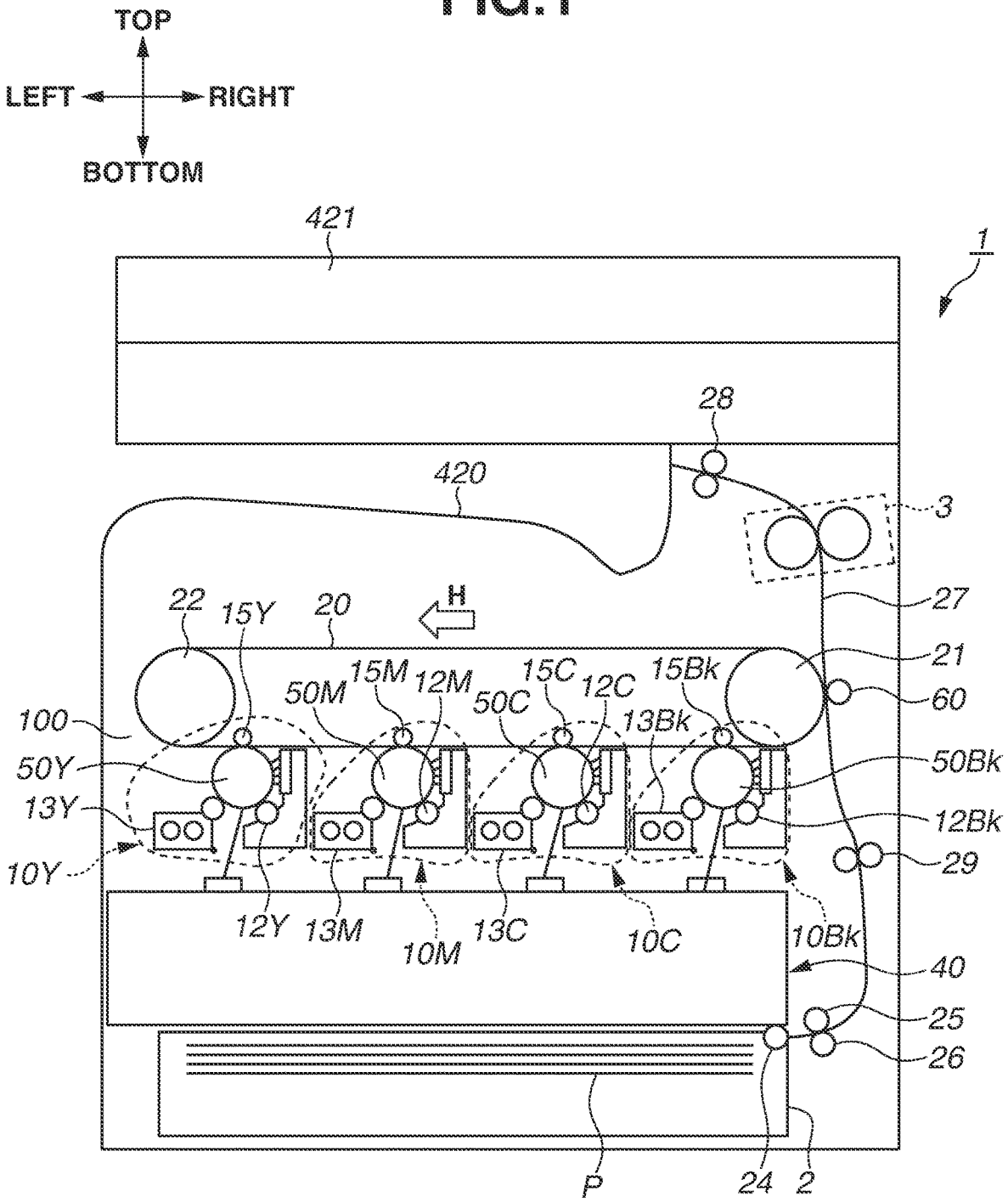
FIG. 1 is a schematic view illustrating a general structure of an example image forming apparatus.

FIG. 1 is a schematic cross-sectional view illustrating an entire structure of an image forming apparatus 1 according to an example embodiment of the present disclosure. As illustrated in FIG. 1, the image forming apparatus 1 according to the present example embodiment includes photosensitive drums 50Y, 50M, 50C, and 50Bk (hereinafter, also referred to collectively as "photosensitive drum 50") for four colors that are yellow (Y), magenta (M), cyan (C), and black (Bk). The image forming apparatus 1 is a tandem-type color laser beam printer that includes four image forming units 10Y, 10M, 10C, and 10Bk for forming toner images of the respective colors. Further, the present example embodiment is not limited to the color image forming apparatus 1 that includes the plurality of photosensitive drums 50 as illustrated in FIG. 1 and may be a color image forming apparatus that includes the single photosensitive drum 50 or an image forming apparatus that forms monochrome images.

The image forming apparatus 1 includes an intermediate transfer belt 20 onto which the respective toner images formed by the image forming units 10Y, 10M, 10C, and 10Bk (hereinafter, also referred to simply as "image forming unit 10") are transferred. The intermediate transfer belt 20 transfers the toner images transferred from the image forming units 10 onto a recording sheet P. The image forming units 10Y, 10M, 10C, and 10Bk have a substantially similar structure except for the colors of toners used by the respective image forming units 10. Hereinafter, the image forming unit 10Y will be described as an example of the image forming unit 10. Overlapped descriptions of the image forming units 10M, 10C, and 10Bk are omitted.

The image forming unit 10Y includes the photosensitive drum 50Y, a charging roller 12Y, a development device 13Y, and a primary transfer roller 15Y. The charging roller 12Y uniformly charges the photosensitive drum 50Y. The development device 13Y develops an electrostatic latent image formed on the photosensitive drum 50Y by an optical scanning apparatus, which will be described below, using the toner and forms a toner image. The primary transfer roller 15Y transfers the formed toner image to the intermediate transfer belt 20. A primary transfer portion is formed by the primary transfer roller 15Y and the photosensitive drum 50Y with the intermediate transfer belt 20 therebetween. A predetermined transfer voltage is applied to the primary transfer roller 15Y so that the toner image formed on the photosensitive drum 50Y is transferred onto the intermediate transfer belt 20.

The intermediate transfer belt 20 is an endless belt stretched around a first belt conveyance roller 21 and a second belt conveyance roller 22 and is rotated in the direction of an arrow H. The toner images formed by the image forming units 10Y, 10M, 10C, and 10Bk are transferred onto the intermediate transfer belt 20 being rotated. The four image forming units 10 are arranged parallel to each other and vertically under the intermediate transfer belt 20. With this arrangement, the toner images formed on the photosensitive drum 50 based on image information about the respective colors are transferred onto the intermediate transfer belt 20.

Further, the first belt conveyance roller 21 and a secondary transfer roller 60 are pressed against each other with the intermediate transfer belt 20 therebetween. With this arrangement, a secondary transfer portion is formed by the first belt conveyance roller 21 and the secondary transfer roller 60 with the intermediate transfer belt 20 therebetween. The recording sheet P is inserted into the secondary transfer portion, and the toner images are transferred from the intermediate transfer belt 20 onto the recording sheet P. The untransferred toner that remains on the surface of the intermediate transfer belt 20 is collected by a cleaning apparatus (not illustrated).

The image forming units 10Y, 10M, 10C, and 10Bk, which respectively form yellow, magenta, cyan, and black toner images, are arranged in this order from an upstream side with respect to the secondary transfer portion in a rotation direction (the direction of the arrow H) of the intermediate transfer belt 20.

Vertically under the image forming units 10 is situated the optical scanning apparatus that scans laser light (light beam) over each of the photosensitive drums 50 corresponding to the respective colors and forms an electrostatic latent image on a surface of each of the photosensitive drums 50.

The optical scanning apparatus herein includes the optical scanning apparatus 40, a rotary polygon mirror (not illustrated), and a reflection mirror (not illustrated). Further, the optical scanning apparatus 40 contains optical members such as a rotary polygon mirror 42 and a reflection mirror 62. The optical scanning apparatus 40 according to the present example embodiment includes four semiconductor lasers (not illustrated) that emit laser light beams modulated based on the image information about the respective colors. The plurality of semiconductor lasers is light sources that expose the respective corresponding photosensitive drums 50. The rotary polygon mirror 42 is rotated at high speed by a polygon motor (not illustrated). In this way, the laser light beams emitted from the semiconductor lasers are reflected to scan the photosensitive drums 50 along a rotation axis direction (main scan direction) of the photosensitive drums 50. Each laser light beam emitted from the semiconductor lasers and reflected by the rotary polygon mirror 42 is guided to an optical system component, such as a lens, in the optical scanning apparatus 40 and is emitted from the inside to the outside of the optical scanning apparatus 40 through a transmission member covering an exit opening at the top of the optical scanning apparatus 40. The respective laser light beams emitted from the optical scanning apparatus 40 expose the photosensitive drums 50.

While the single optical scanning apparatus 40 emits a light beam to each of the four photosensitive drums 50 in the present example embodiment, example embodiments are not limited to the present example embodiment. Each of the four image forming units 10 may include the optical scanning apparatus 40 to emit a single light beam from each optical scanning apparatus 40 to the single corresponding photosensitive drum 50.

Meanwhile, the recording sheet P is stored in a sheet feeding cassette 2 situated in a lower part of the image forming apparatus 1. The recording sheet P is fed by a pickup roller 24 to a separation nip portion formed by a sheet feeding roller 25 and a retard roller 26. Driving is transmitted such that the retard roller 26 is rotated backward when the plurality of recording sheets P is fed by the pickup roller 24. In this way, the plurality of recording sheets P is singly conveyed to prevent feeding of more than one recording sheet P at the same time. The recording sheet P that is singly conveyed by the sheet feeding roller 25 and the retard roller 26 is conveyed to a conveyance path 27 extending substantially vertically along a right side surface of the image forming apparatus 1.

Then, the recording sheet P is vertically conveyed from the bottom of the image forming apparatus 1 toward the top through the conveyance path 27 to a registration roller 29. The registration roller 29 stops the conveyed recording sheet P and corrects the recording sheet P that is skewed. Thereafter, the registration roller 29 conveys the recording sheet P to the secondary transfer portion in synchronization with the timing at which the toner images on the intermediate transfer belt 20 are conveyed to the secondary transfer portion. Thereafter, the recording sheet P with the toner images transferred thereto at the secondary transfer portion is conveyed to a fixing device 3 and heated and pressed by the fixing device 3 so that the toner images are fixed to the recording sheet P. Then, the recording sheet P with the fixed toner images is discharged onto a sheet discharge tray 420 by a sheet discharge roller 28. The sheet discharge tray 420 is situated outside the image forming apparatus 1 and at the top of the main body of the image forming apparatus 1.

(Example Optical Scanning Apparatus)

As described above, in full-color image forming by the image forming apparatus 1 according to the present example embodiment, the optical scanning apparatus 40 exposes the photosensitive drums 50Y, 50M 50C, and 50Bk of the image forming units 10 at respective predetermined timings based on image information about the respective colors. Consequently, toner images of the respective colors based on the image information about the respective colors are formed on the respective photosensitive drums 50. To acquire a high-quality full-color image, the positions at which the respective electrostatic latent images are formed by the optical scanning apparatus 40 are reproduced with high accuracy.

Figure 2B:
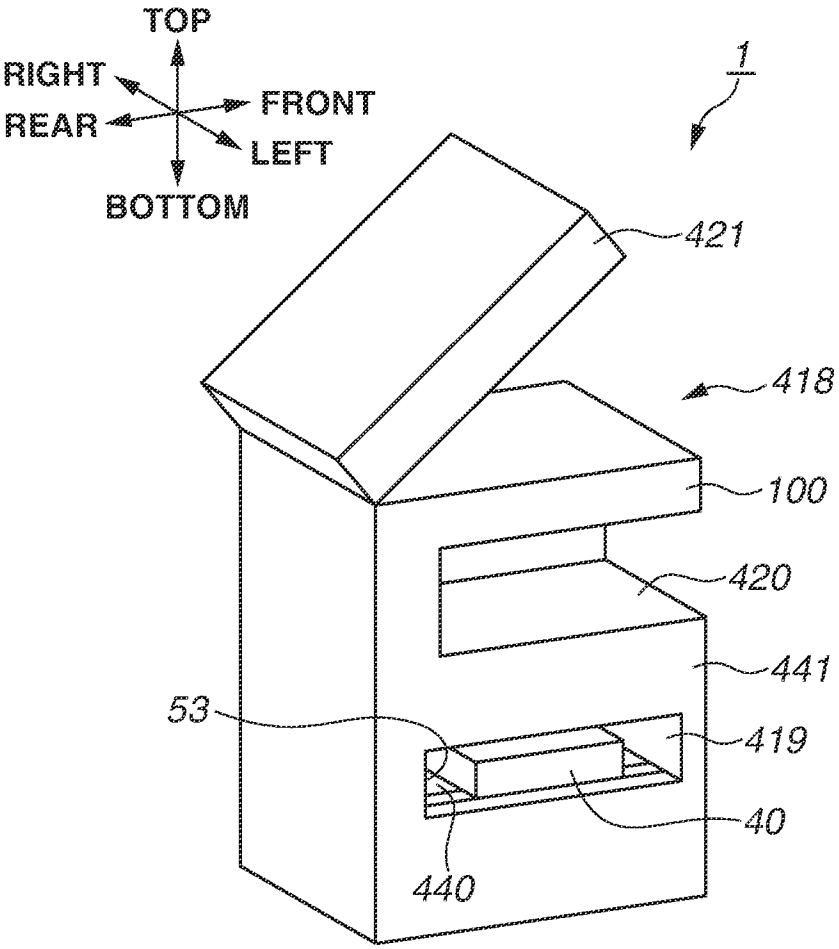
FIGS. 2A and 2B illustrate how an example optical scanning apparatus is attached to and removed from a side surface of the example image forming apparatus.
Figure 2A:
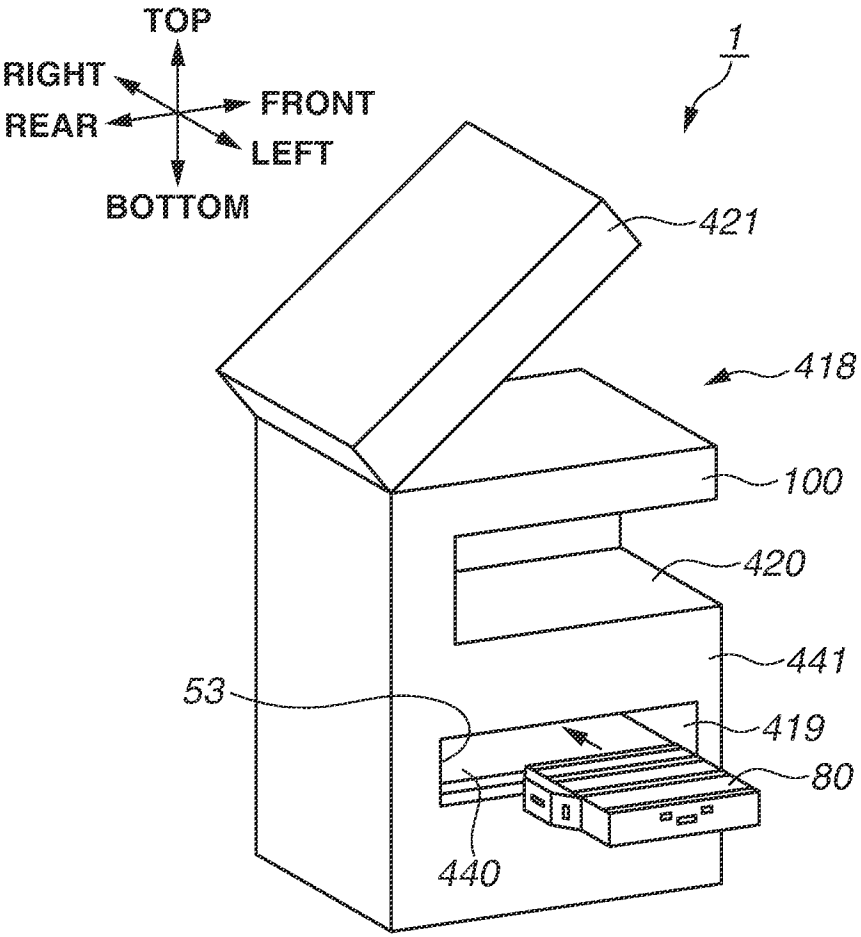

FIGS. 2A and 2B are schematic views illustrating the image forming apparatus 1 illustrated in FIG. 1 according to the present example embodiment. A method of attaching the optical scanning apparatus 40 to the image forming apparatus 1 will be described below with reference to FIGS. 2A and 2B.

FIG. 2A illustrates how an optical box 80 of the optical scanning apparatus 40 is attached to the image forming apparatus 1. As illustrated in FIG. 2A, the image forming apparatus 1 according to the present example embodiment includes an apparatus body 100 and a pressing plate portion 421 at the top of the apparatus body 100. The sheet discharge tray 420 is situated at a middle section of a front side (right-hand side in FIG. 2A) of the apparatus body 100. A side surface 441 of the apparatus body 100 has an opening 419. The optical box 80 is removably attached to an attachment portion 440 in the apparatus body 100 of the image forming apparatus 1 through the opening 419. The opening 419 is covered with a cover member (not illustrated). In other words, the opening 419 is an example of an opening that is formed in the side surface 441 of the apparatus body 100 such that the optical box 80 is inserted from the outside into the apparatus body 100 through the opening 419 and attached to the apparatus body 100. The direction in which the optical box 80 is inserted into the opening 419 at this time, i.e., the direction in which the optical box 80 is attached to the apparatus body 100, is a direction from the left to the right in FIGS. 2A and 2B. The optical box 80 is inserted into the opening 419 toward "a direction (rightward direction) of attachment" to the apparatus body 100 and attached to the apparatus body 100. Further, the optical box 80 is moved from the inside of the apparatus body 100 toward "a direction (leftward direction) of removal" and removed from the apparatus body 100 through the opening 419.

FIG. 2B is a schematic view illustrating the image forming apparatus 1 with the optical box 80 positioned with respect to the apparatus body 100. As illustrated in FIG. 2B, the optical box 80 is attached to the attachment portion 440 in the apparatus body 100 from the outside of the apparatus body 100 through the opening 419 and positioned with respect to the apparatus body 100.

Further, a rear side plate 53 is situated on a back surface side of the apparatus body 100. The optical box 80 attached to the attachment portion 440 through the opening 419 is situated to face the rear plate 53.

Figure 3:
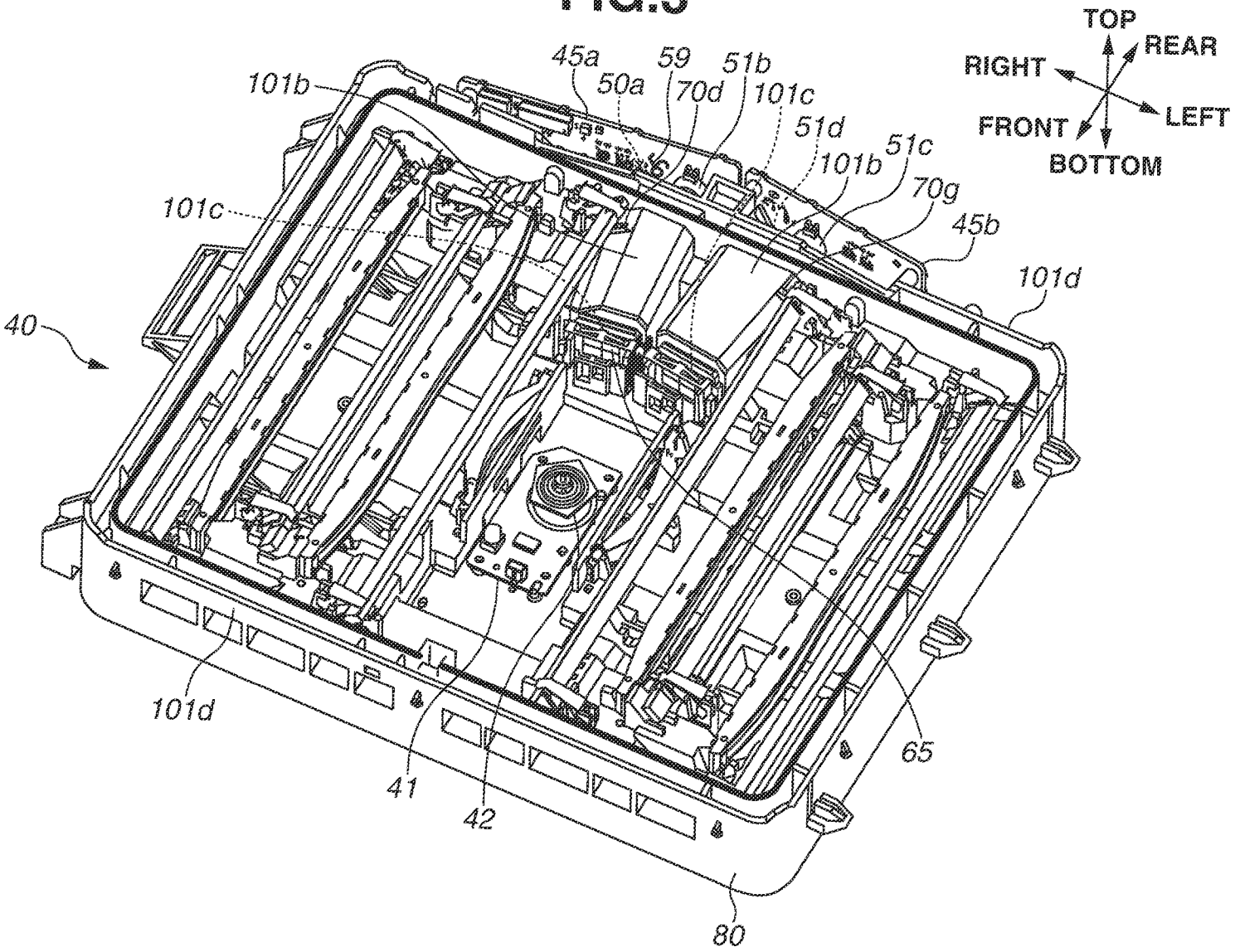
FIG. 3 is a view illustrating a schematic internal structure of the example optical scanning apparatus.

FIG. 3 is a perspective view illustrating the optical scanning apparatus 40 in a state where a top cover 69 (refer to FIG. 5) of the optical box 80 of the optical scanning apparatus 40 is removed and the rotary polygon mirror 42 and optical components are visible. For example, in the present example embodiment, one light source 51 is provided with respect to one image forming unit 10. Specifically, light sources 51*a*, 51*b*, 51*c*, and 51*d* respectively correspond to the image forming units 10Y, 10M, 10C, and 10Bk. Hereinafter, unless necessary, the suffixes a to d of the reference numerals are omitted. The light source 51 is mounted on a circuit substrate 45 together with a laser driver (not illustrated) that drives the light source 51. The circuit substrate 45 is attached to a side wall portion 101*d* arranged vertically from a bottom surface of the optical box 80. Specifically, the two light sources 51*a* and 51*b* are mounted on the circuit substrate 45*a*, and the two light sources 51*c* and 51*d* are mounted on the circuit substrate 45*b*. The light sources 51*a* and 51*b* are mounted on the circuit substrate 45*a* such that optical paths of laser light beams emitted from the light sources 51*a* and 51*b* have an angle difference between each other in the main scan direction and a sub-scan direction (refer to FIG. 6). The two circuit substrates 45*a* and 45*b* are attached to the side wall portion 101*d* of the optical box 80 as illustrated in FIG. 3. A light reception sensor 59 is mounted on the circuit substrate 45*a*. The light reception sensor 59 generates a synchronization signal.

The rotary polygon mirror 42 and a scanner motor 41 are attached to the bottom surface of the optical box 80. The rotary polygon mirror 42 deflects a laser light beam emitted from the light source 51. The scanner motor 41 rotates the rotary polygon mirror 42. The rotary polygon mirror 42 is a polygon mirror that rotates about a rotation axis. A laser light beam emitted from the light source 51 is reflected by the rotary polygon mirror 42, and the laser light beam reflected by the rotary polygon mirror 42 travels toward the photosensitive drum 50 that is a surface to be scanned. Further, a laser light beam emitted from the light source 51*a* is reflected by the rotary polygon mirror 42, and the reflected laser light beam travels toward the light reception sensor 59 mounted on the circuit substrate 45.

The length of time from a timing at which the light reception sensor 59 receives a laser light beam to a start of forming a latent image on the photosensitive drum 50 by the laser light beam is desirably kept constant during operation. The light reception sensor 59 is arranged to keep the length of time constant during operation. Specifically, the light reception sensor 59 is used to determine a timing to emit a laser light beam from the light sources 51*a* to 51*d*. The light reception sensor 59 is situated immediately above the light source 51*a* (chip holder 46*a*). A laser light beam traveling toward the light reception sensor 59 and a laser light beam emitted from the light source 51*a* do not have an angle difference in the main scan direction. Meanwhile, the optical scanning apparatus 40 includes the plurality of light sources 51. For example, the light sources 51*a* and 51*b*, which are an example of a first light source, and the light sources 51*c* and 51*d*, which are an example of a second light source, are respectively arranged on right and left sides based on a plane that is perpendicular to a rotation axis of the rotary polygon mirror 42. For example, the optical paths of laser light beams that are respectively emitted from the light sources 51*a* and 51*b*, which are the two light sources arranged on one side, each have an angle difference (β) in the main scan direction (refer to FIG. 6). The optical paths of laser light beams emitted from the two light sources 51*a* and 51*b* have an angle difference in the main scan direction for the following reason. Specifically, the optical paths of the two laser light beams have an angle difference in the main scan direction such that oblique incident angles of the chip holders 46*a* and 46*b* in the sub-scan direction are small even if the chip holders 46*a* and 46*b*, which will be described below, are increased in size.

When the circuit substrate 45 is attached to the side wall portion 101*d* of the optical scanning apparatus 40, the chip holders 46*a* and 46*b* extend toward the inside of the optical scanning apparatus 40. Thus, the optical box 80 includes a partition portion (hereinafter, referred to as "case portion 101*b*") having a shape to cover the light source 51. The side wall portion 101*d* of the optical box 80 to which the circuit substrate 45 is attached includes an opening 101*c* so that a laser light beam emitted from the light source 51 is guided to the rotary polygon mirror 42. The inside and the outside of the optical scanning apparatus 40 are connected through the opening 101*c*. In other words, air outside the optical scanning apparatus 40 can enter the optical scanning apparatus 40 through the opening 101*c*. Thus, it is desirable to seal the opening 101*c* with a sealing member that seals the opening 101*c*. In the present example embodiment, a cylindrical lens 65 also functions as the sealing member that seals the opening 101*c*. The opening 101*c* is at an end of the case portion 101*b* where the sealing member can be placed with ease. The case portion 101*b* is a partition that separates the inside and the outside of the optical scanning apparatus 40. The opening 101*c* is formed such that a laser light beam emitted from the light source 51*a* travels from the outside of the optical box 80 into the optical box 80 through the opening 101*c*. Further, the opening 101*c* is formed to allow a laser light beam to travel from the inside to the outside of the optical box 80 through the opening 101*c* so that the laser light beam reflected by the rotary polygon mirror 42 is received by the light reception sensor 59. The case portions 101*b* include seats 70*d* and 70*g* on which an optical component is to be placed.

(Example Optical Paths of Laser Light Beams)

Figure 4:
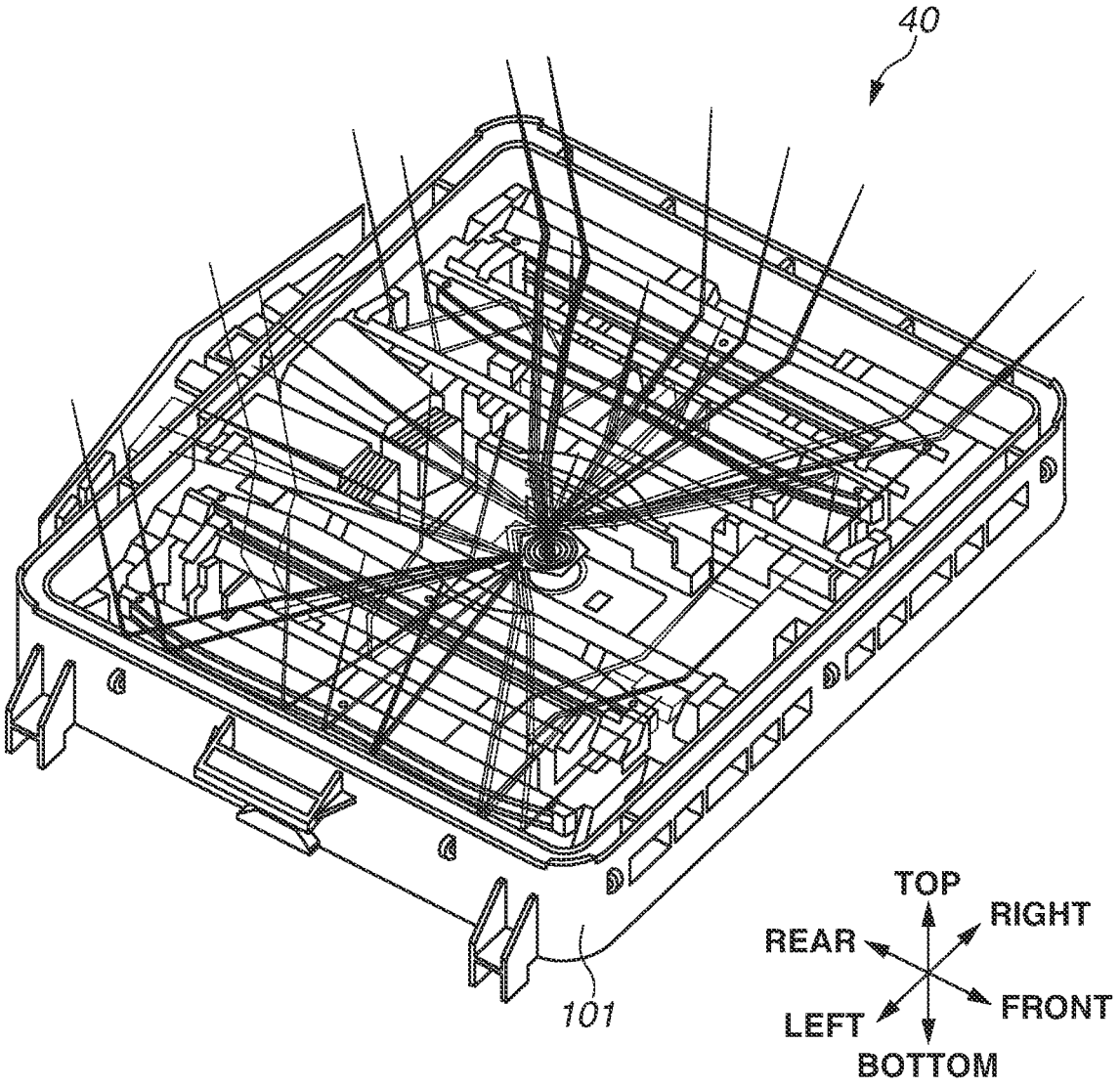
FIG. 4 is a view illustrating optical paths of scan light beams by an example rotary polygon mirror.

FIG. 4 illustrates optical paths of laser light beams in the optical scanning apparatus 40. For ease of view, specific reference numerals of the respective components are not described in FIG. 4. In FIG. 4, optical paths of laser light beams of the four colors at both end portions and a central portion of an image region in the main scan direction are illustrated.

Figure 5:
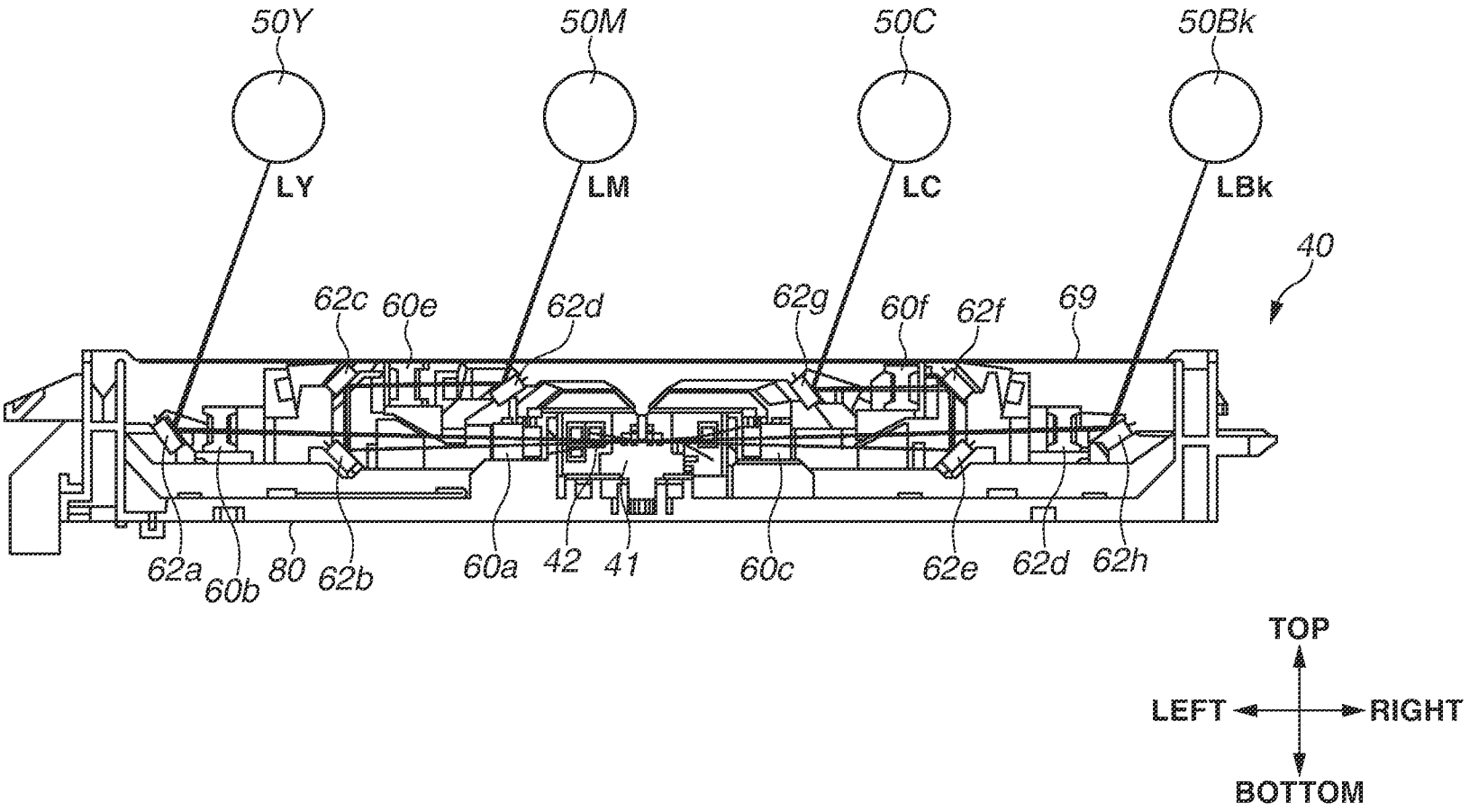
FIG. 5 is a schematic cross-sectional view illustrating the example optical scanning apparatus.

FIG. 5 is a schematic cross-sectional view illustrating the entire optical scanning apparatus 40 with the optical components attached thereto. The optical scanning apparatus 40 includes optical lenses 60*a* to 60*f* and the reflection mirrors 62*a* to 62*h*, which are optical components. The optical lenses 60*a* to 60*f* guide each laser light beam onto the photosensitive drum 50 so that the guided laser light beam forms an image on the photosensitive drum 50. The optical box 80 contains the rotary polygon mirror 42 and the reflection mirrors 62*a* to 62*h* therein.

How laser light beams are guided to the photosensitive drums 50 by the optical lenses 60*a* to 60*f* and the reflection mirrors 62*a* to 62*h* will be described below with reference to FIG. 5. A laser light beam LY emitted from the light source 51*a* and corresponding to the photosensitive drum 50Y is deflected by the rotary polygon mirror 42, and the deflected laser light beam LY enters the optical lens 60*a*. The laser light beam LY having traveled through the optical lens 60*a* enters the optical lens 60*b*, travels through the optical lens 60*b*, and then is reflected by the reflection mirror 62*a*. The laser light beam LY reflected by the reflection mirror 62*a* travels through a transparent window (not illustrated) and scans across the photosensitive drum 50Y.

A laser light beam LM emitted from the light source 51*b* and corresponding to the photosensitive drum 50M is deflected by the rotary polygon mirror 42, and the deflected laser light beam LM enters the optical lens 60*a*. The laser light beam LM having traveled through the optical lens 60*a* is reflected by the reflection mirrors 62*b* and 62*c*, and the reflected laser light beam LM enters the optical lens 60*e*, travels through the optical lens 60*e*, and then is reflected by the reflection mirror 62*d*. The laser light beam LM reflected by the reflection mirror 62*d* travels through a transparent window (not illustrated) and scans across the photosensitive drum 50M. Each laser light beam emitted from the light sources 51*a* and 51*b* and deflected by the rotary polygon mirror 42 first enters the optical lens 60*a* among the plurality of optical members.

A laser light beam LC emitted from the light source 51*c* and corresponding to the photosensitive drum 50C is deflected by the rotary polygon mirror 42, and the deflected laser light beam LC enters the optical lens 60*c*. The laser light beam LC having traveled through the optical lens 60*c* is reflected by the reflection mirrors 62*e* and 62*f*, and the reflected laser light beam LC enters the optical lens 60*f*, travels through the optical lens 60*f*, and then is reflected by the reflection mirror 62*g*. The laser light beam LC reflected by the reflection mirror 62*g* travels through a transparent window (not illustrated) and scans across the photosensitive drum 50C.

A laser light beam LBk emitted from the light source 51*d* and corresponding to the photosensitive drum 50Bk is deflected by the rotary polygon mirror 42, and the deflected laser light beam LBk enters the optical lens 60*c*. The laser light beam LBk having traveled through the optical lens 60*c* enters the optical lens 60*d*, travels through the optical lens 60*d*, and is then reflected by the reflection mirror 62*h*. The laser light beam LBk reflected by the reflection mirror 62*h* travels through the transparent window (not illustrated) and scans across the photosensitive drum 50Bk. Each laser light beam emitted from the light sources 51*c* and 51*d* and deflected by the rotary polygon mirror 42 first enters the optical lens 60*c* among the plurality of optical members.

In order to minimize the size of the optical box 80, the optical scanning apparatus 40 has a structure as described below. The size of the optical box 80 is determined such that the reflection mirror 62 is long enough to guide each laser light beam to a scan surface and the optical box 80 has the smallest possible size to house the reflection mirror 62. In the optical box 80 with this size, the light source 51 is arranged to fit the side wall portion 101*d* of the optical box 80. In this way, the size of the entire optical scanning apparatus 40 is reduced.

Figure 6:
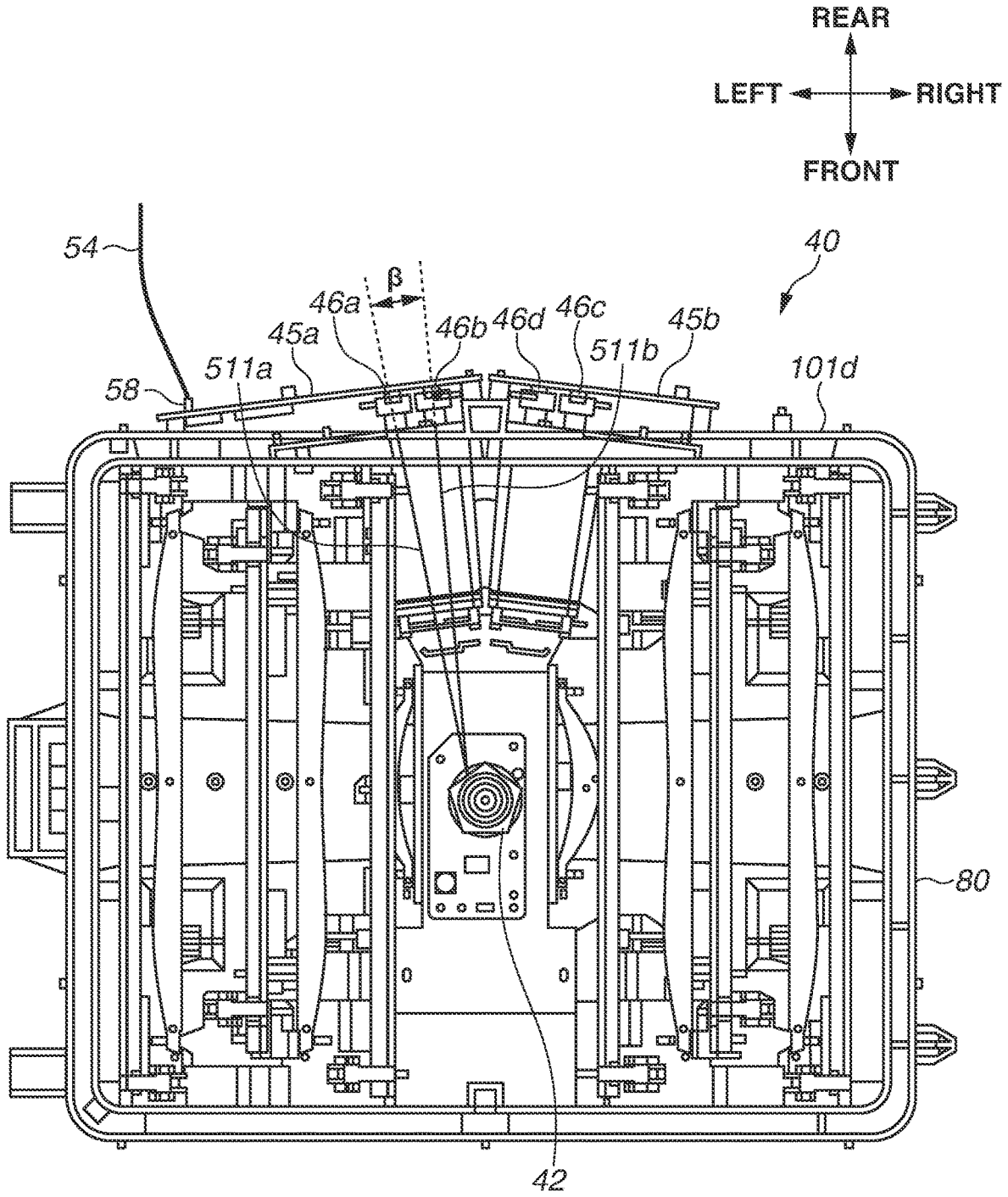
FIG. 6 is a view illustrating the inside of the example optical scanning apparatus viewed from above.

FIG. 6 is a schematic view illustrating the optical scanning apparatus 40 when the inside of the optical scanning apparatus 40 is viewed from above. The light source 51 is held by the chip holder 46. As illustrated in FIG. 6, the chip holder 46 is situated at the side wall portion 101*d* of the optical box 80.

In the present example embodiment, for example, the light source 51 that has an outer diameter of φ11.6 and includes eight light emitting points is used. In arranging the light sources 51 at the side wall portion 101*d* of the optical box 80, it is desirable to arrange the light sources 51 such that the two light sources 51 have a great angle difference, in order to prevent interference between two circuit substrates 45 in a case where the two light sources 51 on the same circuit substrate 45 have an angle difference only in the sub-scan direction (upward and downward directions). The angle difference between the two light sources 51 refers to an angle that is formed by optical paths 511*a* and 511*b*. The optical path 511*a* is an optical path of a laser light beam emitted from the light source 51*a*, and the optical path 511*b* is an optical path of a laser light beam emitted from the light source 51*b*. If the angle difference between the optical paths 511*a* and 511*b* of the two light sources 51 in the sub-scan direction increases, a reflection surface of the rotary polygon mirror 42 departs from an ideal position, and this increases errors of positions at which laser light beams arrive on the photosensitive drum 50. Consequently, image quality decreases. For example, decentering of the rotary polygon mirror 42 causes an irradiation position of a laser light beam on the photosensitive drum 50 to deviate.

In order to reduce the angle difference between the optical paths 511*a* and 511*b* of the two the light sources 51*a* and 51*b* in the sub-scan direction, the circuit substrate 45 is assumed to be situated away from the rotary polygon mirror 42. In this case, the side wall portion 101*d* of the optical scanning apparatus 40 on which the circuit substrate 45 is to be situated needs to be away from the rotary polygon mirror 42. In other words, the size of the optical box 80 in a front-rear direction increases. Thus, in order to minimize the size of the optical scanning apparatus 40 while maintaining adequate image quality, the circuit substrate 45 is arranged to have an angle difference also in the main scan direction and emit laser light beams. Thus, the side wall portion 101*d* of the optical box 80 can be situated near the rotary polygon mirror 42, and the size of the optical box 80 in a Y-axis direction is reduced. An angle β that is a second angle specified in FIG. 6 is an illustration of the angle difference in the main scan direction between the chip holders 46*a* and 46*b* on the circuit substrate 45. The angle β in the main scan direction is an angle in the main scan direction that is formed by the optical path 511*a* (broken line) and the optical path 511*b* (broken line).

As illustrated in FIG. 6, a connector 58 is provided to the circuit substrate 45*a* among the two circuit substrates 45*a* and 45*b* of the optical box 80. The connector 58 is connected to a flexible flat cable 54, and the flexible flat cable 54 is connected to a control unit (not illustrated) of the apparatus body 100. The flexible flat cable 54 is a cable in which a plurality of conductors arranged in parallel is sandwiched by an insulator, such as a resin sheet, from both sides and shaped into a tape. A control signal from the control unit is input to the circuit substrate 45*a* via the flexible flat cable 54. Although not illustrated in FIG. 6, the circuit substrates 45*a* and 45*b* are electrically connected to each other via a cable. While the circuit substrates 45*a* and 45*b* are separated in the present example embodiment, the circuit substrates 45*a* and 45*b* can be integrated as a single substrate. In this case, a chip holder corresponding to the chip holders 46*a* and 46*d* is mounted on the single circuit substrate.

The control signal is transmitted from the control unit to the circuit substrates 45*a* and 45*b* to control driving of the optical scanning apparatus 40. In this way, a desired latent image is formed on the photosensitive drum 50.

Further, as illustrated in FIG. 6, the circuit substrate 45*a* and the connector 58 are both arranged to be exposed from the optical box 80. Thus, when the optical box 80 is attached to the apparatus body 100, the circuit substrate 45*a* faces the rear plate 53. Specifically, the connector 58 protrudes from the circuit substrate 45*a* toward the rear plate 53. The rear plate 53 is a metal plate situated on the back surface side of the apparatus body 100 of the image forming apparatus 1. The rear plate 53 is grounded.

The rear plate 53 and the connector 58 are arranged to face each other so that the flexible flat cable 54 extends from the connector 58 toward the rear plate 53 and comes into contact with the rear plate 53. Details thereof will be described below. The flexible flat cable 54 is flexible, so that when the flexible flat cable 54 is in a curved state, a force to elongate is exerted on the flexible flat cable 54. Thus, a force to cancel the curved state is exerted on the flexible flat cable 54 curved near the rear plate 53, and the flexible flat cable 54 is pressed toward the rear plate 53, and the flexible flat cable 54 and the rear plate 53 come into contact with each other. The flexible flat cable 54 is brought into contact with the rear plate 53, which is made of a metal and grounded, so that the flexible flat cable 54 is also grounded. In this way, electromagnetic wave noise from the flexible flat cable 54 is reduced.

Methods of reducing electromagnetic wave noise from the flexible flat cable 54 are not limited to the above-described method in which a portion of the flexible flat cable 54 is brought into contact with the rear plate 53 that is grounded, and there is also a method in which, for example, each flexible flat cable 54 is covered with a metal plate. For example, a metal plate similar to the rear plate 53 can be arranged on the right and left sides of the optical box 80 so that the metal plates are on the front, rear, left, and right sides of the flexible flat cable 54. This method, however, has issues that installation of the new metal plates increases costs and the weight of the image forming apparatus 1 increases. With a method in which a holding member 55 (an example of a guide member) is placed in front of a wall portion 53*a* of the rear plate 53 and a portion of the flexible flat cable 54 is brought into contact with the rear plate 53 as in the present example embodiment, noise is controlled at low cost.

Further, electromagnetic wave noise emitted from the flexible flat cable 54 can affect the other electronic components in the apparatus body 100 and can also affect other electronic devices outside the apparatus body 100. With the method according to the present example embodiment of the present disclosure, electromagnetic wave noise that is emitted to the outside of the image forming apparatus 1 is also reduced.

(Example Cabling of Flexible Flat Cable)

Figure 7A:
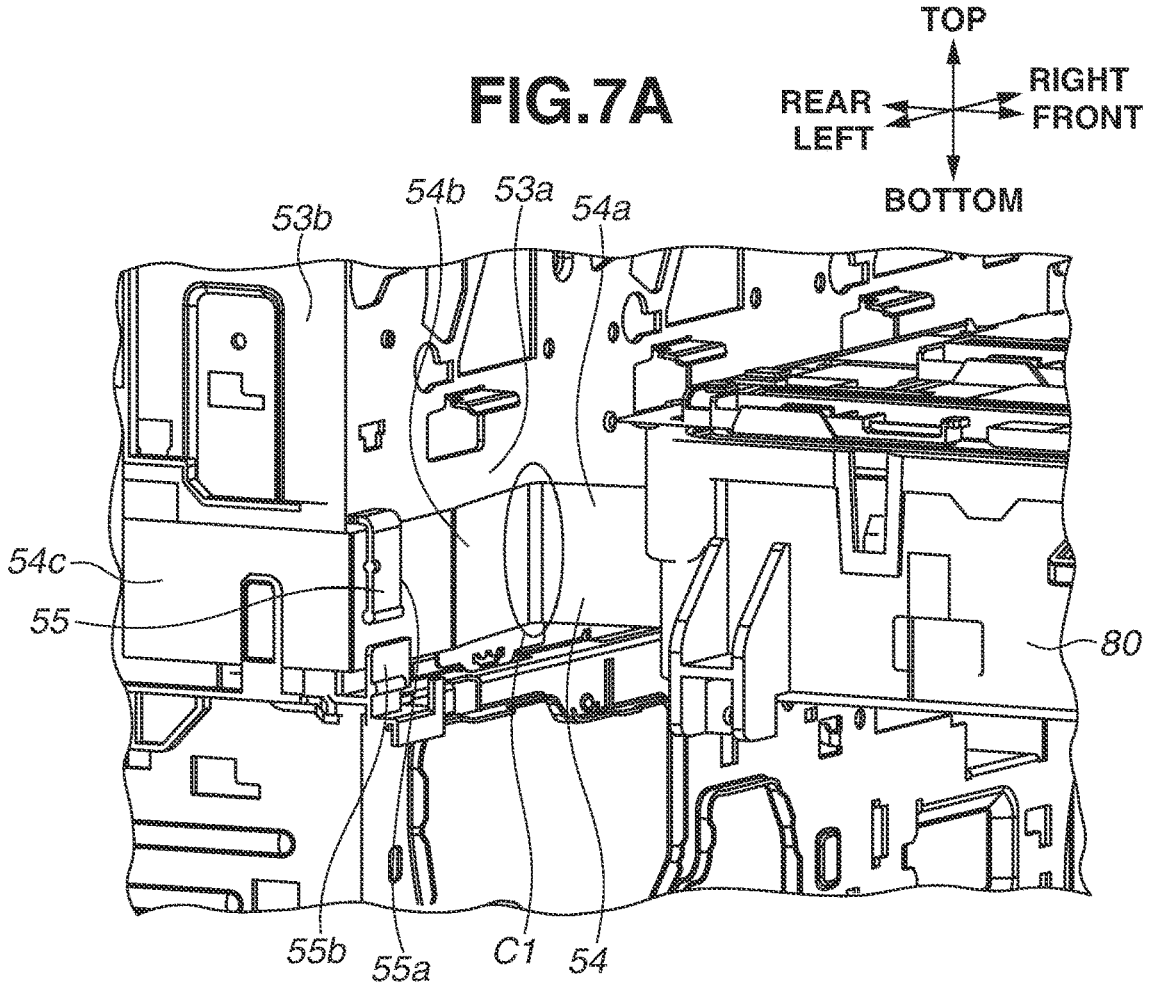
FIGS. 7A and 7B are views illustrating example cabling of a flexible flat cable.
Figure 7B:
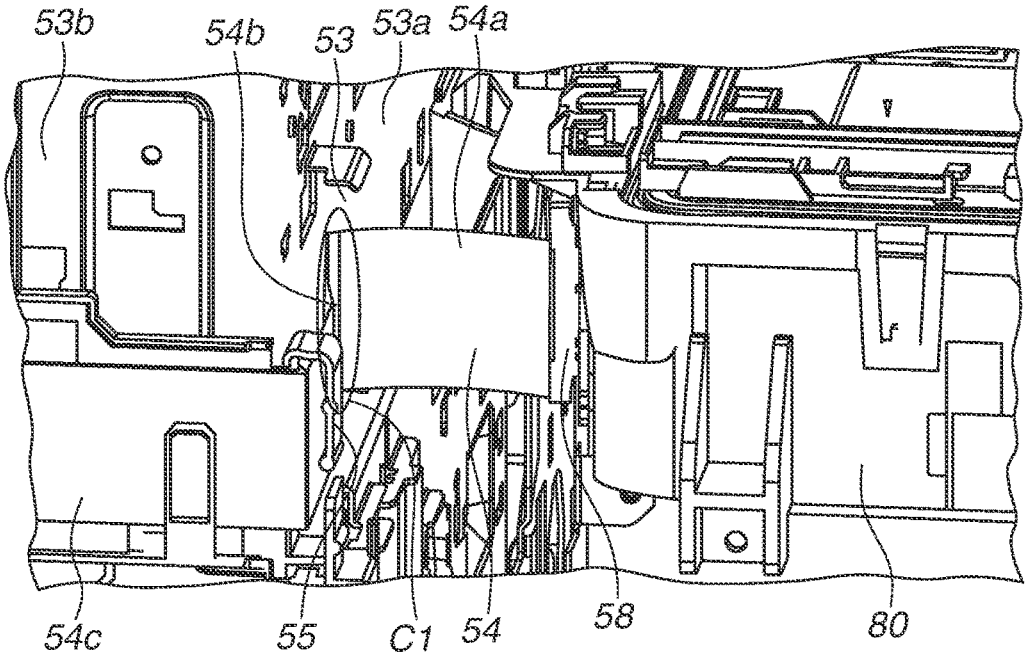

FIGS. 7A and 7B are views illustrating cabling of the flexible flat cable 54. In FIG. 7A, the optical box 80 attached to the apparatus body 100 is viewed from the opening 419 of the left side surface 441 of the apparatus body 100.

Although hidden and not visible in FIG. 7A, the flexible flat cable 54 extends from the circuit substrate 45*a* exposed from a rear side wall of the optical box 80 toward the rear plate 53. As illustrated in FIG. 7A, the rear plate 53 is bent and includes the wall portion 53*a* and a wall portion 53*b*. The wall portion 53*a* faces the rear side wall of the optical box 80 attached to the apparatus body 100. Further, the wall portion 53*b* is a surface that is adjacent to the wall portion 53*a* and is bent at about 90 degrees with respect to the wall portion 53*a*, and a portion of the wall portion 53*b* is exposed from the opening 419.

The flexible flat cable 54 extending from the connector 58 of the circuit substrate 45*a* toward the wall portion 53*a* is bent near the wall portion 53*a* toward the opening 419 and forms a curved portion C1. The flexible flat cable 54 that forms the curved portion C1 and extends toward the opening 419 is held on the rear plate 53 by the holding member 55 attached to the rear plate 53. The flexible flat cable 54 guided by the holding member 55 to be cabled along the wall portion 53*a* is bent along the shape of the rear plate 53 and extends along the wall portion 53*b* to the control unit of the apparatus body 100. Since the flexible flat cable 54 has flexibility, a force to elongate is exerted on the flexible flat cable 54 when the flexible flat cable 54 is curved, so that a portion of the flexible flat cable 54 in the vicinity of the curved portion C1 is pressed against the wall portion 53*a* of the rear plate 53.

Alternatively, the flexible flat cable 54 can be bent in the vicinity of the wall portion 53*a* of the rear plate 53 from the connector 58 toward the opening 419 and the bent line portion can be brought into contact with the rear plate 53. The bent line is formed as described above to realize more stable cabling along the wall portion 53*a* of the rear plate 53. At this time, the holding member 55 may guide the flexible flat cable 54 so that the bent line comes into contact with the wall portion 53*a* of the rear plate 53.

In the present example embodiment, the holding member 55 is fixed to the wall portion 53*a* of the rear plate 53. In this way, the flexible flat cable 54 is supported at a position facing the wall portion 53*a*. A function of the holding member 55 is to hold the flexible flat cable 54 along the wall portion 53*a* at a position facing the wall portion 53*a*. As illustrated in FIG. 7A, the holding member 55 is situated in front of the wall portion 53*a* to support the flexible flat cable 54, which extends from the control unit along the wall portion 53*b*, at a position facing the wall portion 53*a*. In view of what has been described above, the holding member 55 can be fixed to either one of the wall portions 53*a* and 53*b* of the rear plate 53 to hold the flexible flat cable 54 along the wall portion 53*a* at a position facing the wall portion 53*a*.

Further, it is desirable, but not required, that the holding member 55 should have a function of fixing the flexible flat cable 54 to the rear plate 53. In the present example embodiment, the holding member 55 merely guides the flexible flat cable 54 along the wall portion 53*a* to maintain the state where the flexible flat cable 54 extending from the connector 58 to the wall portion 53*a* is in contact with the wall portion 53*a*.

To simplify description, the flexible flat cable 54 is divided into three regions 54*a*, 54*b*, and 54*c* as illustrated in FIG. 7A, and each of the three regions 54*a*, 54*b*, and 54*c* will be described below. The surface 54*a* is a region of the flexible flat cable 54 from a portion that is connected to the connector 58 to the curved portion C1. The surface 54*b* is a region of the flexible flat cable 54 from the curved portion C1 to a portion that is held by the holding member 55. The surface 54*c* is a region of the flexible flat cable 54 that is situated along the wall portion 53*b*.

In the present example embodiment, the distance of the surface 54*a* in a lengthwise direction of the flexible flat cable 54 is set longer than the distance from the connector 58 to the wall portion 53*a*. Thus, the flexible flat cable 54 is in contact with the wall portion 53*a* at the curved portion C1, and the surface 54*a* is slightly curved. The holding member 55 holds the flexible flat cable 54 on the rear plate 53 in order to maintain the state of the flexible flat cable 54 in the above-described state. The holding member 55 holds the flexible flat cable 54 so that the contact state in which the flexible flat cable 54 and the rear plate 53 are in contact with each other is maintained, and the flexible flat cable 54 is reliably grounded.

The holding member 55 includes two arms that are an upper arm portion 55*a* and a lower arm portion 55*b*. The upper arm portion 55*a* holds the flexible flat cable 54 to clutch the flexible flat cable 54 from vertically above. Further, the lower arm portion 55*b* holds the flexible flat cable 54 to clutch the flexible flat cable 54 from vertically below. A main role of the lower arm portion 55*b* is to support the flexible flat cable 54.

In the present example embodiment, the flexible flat cable 54 is held by being sandwiched between the upper arm portion 55*a* and the wall portion 53*a*. In this way, the flexible flat cable 54 is guided by the holding member 55.

For example, in the present example embodiment, the state where the flexible flat cable 54 "is guided" by the holding member 55 refers to a state where the flexible flat cable 54 is held by the holding member 55.

A state where, for example, the flexible flat cable 54 is not held by the upper arm portion 55*a* and is supported by the lower arm portion 55*b* is also considered as the state where the flexible flat cable 54 is guided by the holding member 55.

The state where the flexible flat cable 54 "is guided" by the holding member 55 is not limited to a state where the flexible flat cable 54 is held or supported by the holding member 55. To guide the flexible flat cable 54, the holding member 55 is brought into contact with the flexible flat cable 54 to direct a cabling direction of the flexible flat cable 54. In this case, a contact portion of the holding member 55 and the flexible flat cable 54 corresponds to a portion that is guided by the holding member 55.

The upper arm portion 55*a* and the lower arm portion 55*b* may both press the flexible flat cable 54 against the wall portion 53*a* of the rear plate 53. In this case, not only the curved portion C1 of the flexible flat cable 54 but also a portion of the flexible flat cable 54 that is held by the holding member 55 are in contact with the wall portion 53*a* of the rear plate 53. The upper arm portion 55*a* presses one of the surfaces of the surface 54*b* of the flexible flat cable 54 that is opposite to the surface facing the wall portion 53*a*, whereby the flexible flat cable 54 is brought into contact with the wall portion 53*a*. A minimal function of the holding member 55 is the function of holding the flexible flat cable 54, so that the holding member 55 does not have to include the function of bringing the flexible flat cable 54 into contact with the wall portion 53*a* of the rear plate 53. For example, the holding member 55 may hold the flexible flat cable 54 by sandwiching the front and back surfaces of the flexible flat cable 54. The flexible flat cable 54 is arranged not to move with respect to the rear plate 53 so that the contact state where the flexible flat cable 54 is in contact with the wall portion 53*a* of the rear plate 53 at the curved portion C1 is maintained.

FIG. 7B is a view illustrating the flexible flat cable 54 held by the holding member 55 and connected to the connector 58. To simplify description, description of some of the members that are given reference numerals that are the same as those in FIG. 7A is omitted. In FIG. 7B, the optical box 80 and the flexible flat cable 54 are viewed from an angle at which the connector 58 is visible.

As illustrated in FIG. 7B, the connector 58 is exposed from the rear side of the optical box 80 and faces the wall portion 53*a* of the rear plate 53. Further, the connector 58 is situated on the circuit substrate 45*a* (not illustrated) such that a lengthwise direction of the connector 58 corresponds to the vertical direction, and the circuit substrate 45*a* is fixed to the optical box 80. Thus, the flexible flat cable 54 extends from the connector 58 toward the wall portion 53*a* and comes into contact with the wall portion 53*a*. The flexible flat cable 54 extending from the connector 58 is curved at the curved portion C1 and then extends toward the holding member 55. In other words, the flexible flat cable 54 is connected to the connector 58 and held by the holding member 55 so that the curved state is maintained. In this way, a portion of the flexible flat cable 54 is in contact with the wall portion 53*a* of the rear plate 53.

Figure 8:
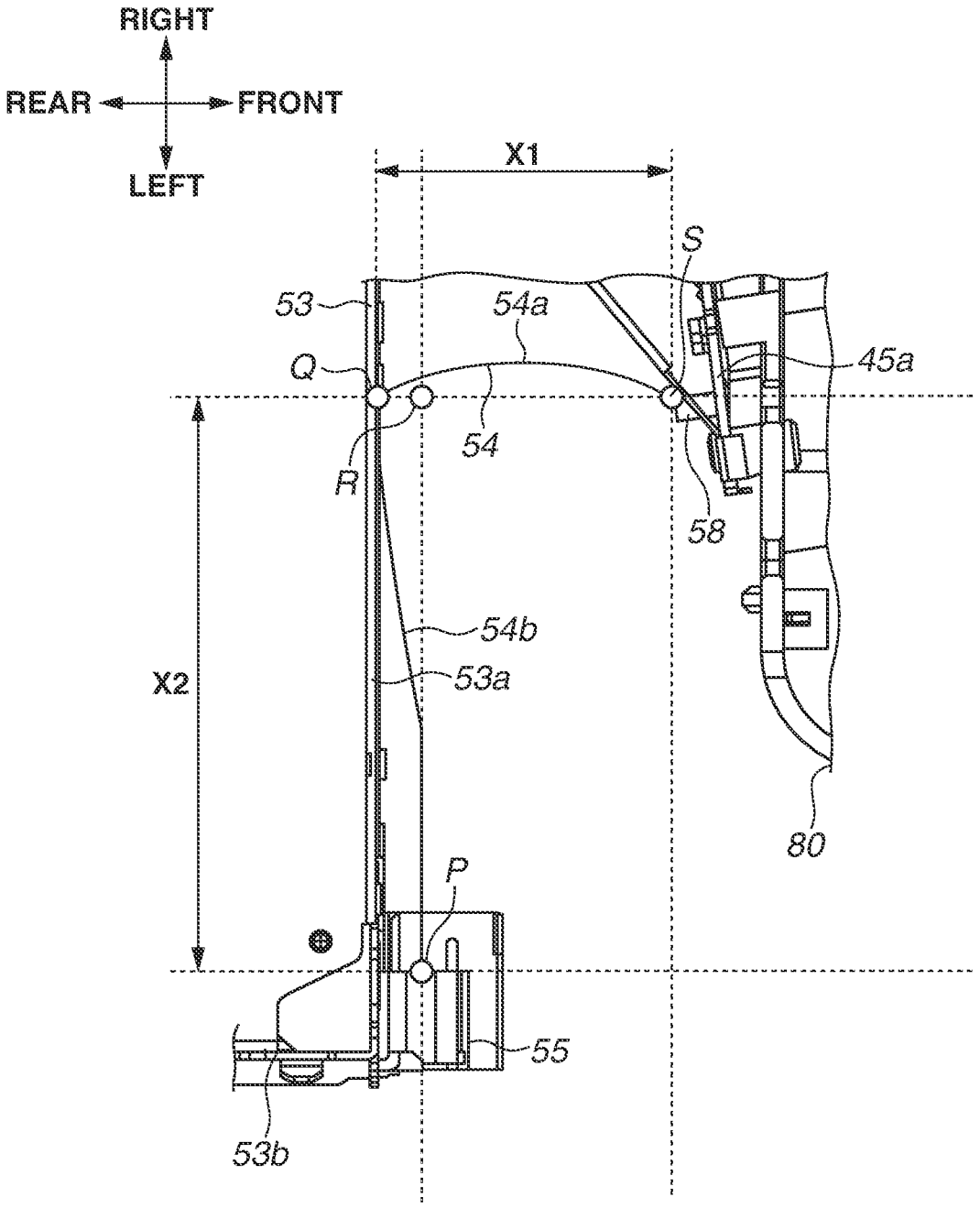
FIG. 8 is a view illustrating the cabling of the flexible flat cable viewed from above in a vertical direction.

FIG. 8 is a view illustrating the flexible flat cable 54 viewed from vertically above. The flexible flat cable 54 is held by the holding member 55 and arranged near the rear plate 53.

As illustrated in FIG. 8, a portion where the holding member 55 holds the flexible flat cable 54 is denoted by a point P, and a connection portion of the flexible flat cable 54 and the connector 58 is denoted by a point S. Further, an intersection point of a perpendicular line (an example of a first virtual line) from the point S to the wall portion 53*a* of the rear plate 53 and the wall portion 53*a* of the rear plate 53 is denoted by a point Q, and an intersection point of a perpendicular line (an example of a second virtual line) from the point P toward a line segment QS, which is an example of the first virtual line, and the line segment QS is denoted by a point R (an example of the intersection point). The points P, Q, R, and S and the line segment QS, which is the first virtual line, and a line segment PR, which is the second virtual line, are defined as described above.

The surface 54*a* of the flexible flat cable 54, which is the region from the connection portion that is connected to the connector 58 to the contact portion that is in contact with the wall portion 53*a* of the rear plate 53, is curved to the right side of the apparatus body 100 from the line segment QS. Specifically, the length of the surface 54*a* in the lengthwise direction of the flexible flat cable 54 is longer than a length X1 of the line segment QS. Thus, the surface 54*a* is curved and is in contact with the wall portion 53*a* of the rear plate 53. In the present example embodiment, the flexible flat cable 54 has a flexural strength of 100 MPa or greater. Thus, the flexible flat cable 54 extending from the connector 58 is always in a state of being pressed against the wall portion 53*a* of the rear plate 53 and the shape of the flexible flat cable 54 is maintained in this state. While the value of 100 MPa or greater is described as an example of the flexural strength of the flexible flat cable 54 in present example embodiment, even in a case where the flexural strength is less than the above-described value, if the length of the surface 54*a* of the flexible flat cable 54 is longer than the length X1, which is the distance of the line segment QS, the flexible flat cable 54 being curved attempts to elongate, so that the flexible flat cable 54 comes into contact with the wall portion 53*a* of the rear plate 53.

Further, the distance from the portion of the flexible flat cable 54 that is held by the holding member 55 to the portion of the flexible flat cable 54 that is in contact with the wall portion 53*a* of the rear plate 53, i.e., the length of the surface 54*b* in the lengthwise direction of the flexible flat cable 54, is longer than a length X2 of the line segment PR. In order to reliably bring a portion of the flexible flat cable 54 into contact with the wall portion 53*a* of the rear plate 53, the shape of the flexible flat cable 54 is maintained such that (1) the length of the surface 54*a* in the lengthwise direction of the flexible flat cable 54 is longer than the length X1 of the line segment QS and (2) the length of the surface 54*b* in the lengthwise direction of the flexible flat cable 54 is longer than the length X2 of the line segment PR. Thus, in the present example embodiment, the flexible flat cable 54 is guided by the holding member 55 such that the length from the portion of the flexible flat cable 54 that is held by the holding member 55 to the connection portion of the flexible flat cable 54 that is connected to the connector 58 is longer than the sum of X1+X2, which is the sum of the length X2 of the line segment PR and the length X1 of the line segment QS.

A material of the rear plate 53 is a metal (iron). Thus, the rear plate 53 is used as an electrical ground of the image forming apparatus 1. The rear plate 53 as the ground reduces noise emission. Thus, the flexible flat cable 54 is brought into contact with the noise-reducing member so that noise emission from the flexible flat cable 54 is reduced. Further, especially the optical scanning apparatus 40 easily emits noise because high-speed signals are input to the optical scanning apparatus 40. Thus, the state where the flexible flat cable 54 connected to the circuit substrate 45*a* of the optical scanning apparatus 40 is in contact with the rear plate 53 is effective for noise reduction.

Further, there is a type of the flexible flat cable 54 that is with a shield. In the flexible flat cable 54 that is with the shield, a resin sheet covering both sides of a conductor is covered with a metal foil sheet in order to reduce an effect of electric signal noise on an electric signal that is transmitted through the conductor of the flexible flat cable 54. Even in a case where the flexible flat cable 54 with the shield is used, the flexible flat cable 54 is reliably grounded if the flexible flat cable 54 is guided by the holding member 55 such that a portion of the flexible flat cable 54 is brought into contact with the metal rear plate 53.

As illustrated in FIG. 8, the connector 58 is situated closer to the right side of the apparatus body 100 than the holding member 55 is. In other words, the connector 58 is situated farther than the holding member 55 (refer to FIGS. 2A and 2B) when the inside of the apparatus body 100 is viewed from the opening 419 of the side surface 441 of the apparatus body 100. Specifically, the connector 58 is situated downstream of the holding member 55 in the direction of attachment of the optical box 80 to the apparatus body 100. The holding member 55 and the connector 58 have this positional relationship often in a case where the optical scanning apparatus 40 is a facing scanning system as described in the present example embodiment. As used herein, the term "facing scanning system" refers to a system in which a light beam incident on the rotary polygon mirror 42 is deflected leftward and rightward by the rotary polygon mirror 42 being rotated as described in the optical scanning apparatus according to the present example embodiment (refer to FIG. 4). In other words, light beams emitted from the light sources 51*a* and 51*b* and light beams emitted from the light sources 51*c* and 51*d* are respectively deflected toward the opposite sides by the rotary polygon mirror 42.

In the optical scanning apparatus 40 of the facing scanning system, the rotary polygon mirror 42 is situated in the vicinity of a center of the optical box 80. Thus, the circuit substrates 45*a* and 45*b* on which the light sources 51*a*, 51*b*, 51*c*, and 51*d* that emit a light beam toward the rotary polygon mirror 42 are provided are also situated close to each other in the vicinity of the center of the optical box 80 in the rightward and leftward directions. Thus, the connector 58 attached to the circuit substrate 45*a* is not situated, for example, near a left end portion of the optical box 80, i.e., near the opening 419 in a state where, the optical scanning apparatus 40 is attached to the apparatus body 100. Thus, the connector 58 is situated closer to the right side of the apparatus body 100 than the holding member 55 is.

There are not only the optical scanning apparatuses of the facing scanning system described above but also the optical scanning apparatuses of a one-side scanning system. The term "one-side scanning system" refers to a system in which a light beam incident on the rotary polygon mirror 42 is deflected to one side by the rotary polygon mirror 42 being rotated.

In the optical scanning apparatus 40 of the one-side scanning system, for example, the rotary polygon mirror 42 is situated near the left end of the optical box 80. Therefore, a circuit substrate on which a light source that emits a light beam toward the rotary polygon mirror 42 is mounted is also situated close to the left side of the optical box 80 in the rightward and leftward directions. Thus, a connector attached to the circuit substrate can be situated near the left end portion of the optical box 80, i.e., near the opening 419 in a state where the optical scanning apparatus 40 is attached to the apparatus body 100. Specifically, the connector can be situated on the left side of the holding member 55. In other words, the connector 58 is situated upstream of the holding member 55 in the direction of attachment of the optical box 80 to the apparatus body 100. Even in this case, the flexible flat cable 54 is still brought into contact with the wall portion 53*a* of the rear plate 53 by defining the distance of the length X1 and the length of the surface 54*a* and defining the distance of the length X2 and the length of the surface 54*b* as described above with reference to FIG. 8.

The descriptions of the example embodiment described above are mere examples in all aspects and are not limitative. For example, the connector 58 may be attached to the circuit substrate 45*a* such that the lengthwise direction of the connector 58 is perpendicular to the vertical direction. In this case, the flexible flat cable 54 extends from the connector 58 toward the wall portion 53*a* of the rear plate 53 with one of the surfaces of the flexible flat cable 54 facing vertically upward. Then, the flexible flat cable 54 comes into contact with the wall portion 53*a*, is folded several times, and is then cabled toward the opening 419. The length of the flexible flat cable 54 from the connection portion that is connected to the connector 58 to the contact portion that is in contact with the wall portion 53*a* is set longer than the direct distance between the connector 58 and the contact portion so that the flexible flat cable 54 is brought into contact with the wall portion 53*a*.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-107373, filed Jun. 7, 2019, which is hereby incorporated by reference herein in its entirety.

What is claimed is:

1. An image forming apparatus comprising:

a metal rear plate on a back surface side of the image forming apparatus and grounded;

a photosensitive drum;

an optical box attached to a position facing the rear plate through an opening of a side surface of the image forming apparatus, the optical box including a substrate that includes a connector and a light source configured to emit a light beam to which the photosensitive drum is exposed;

a flexible flat cable connected to the connector and configured to transmit a signal to drive the substrate; and a guide member configured to curve the flexible flat cable toward the side surface and guide the flexible flat cable toward the side surface along a wall portion of the rear plate that faces the optical box in a front-rear direction, the flexible flat cable extending from the connector toward the wall portion, and the guide member being on the wall portion, wherein a first virtual line is defined as a perpendicular line from the connector to the wall portion and a second virtual line is defined as a perpendicular line from the guide member to the first virtual line, and wherein a distance from a connection portion of the flexible flat cable that is connected to the connector to a portion of the flexible flat cable that is guided by the guide member is longer than a sum of a length of the first virtual line and a length of the second virtual line, and the flexible flat cable guided by the guide member is in contact with the wall portion.

2. The image forming apparatus according to claim 1, wherein the guide member is situated upstream of the connector in a direction of the attachment.

3. The image forming apparatus according to claim 2, wherein the flexible flat cable extending from the connector is bent toward the opening to form a bent line, and the bent line is in contact with the rear plate.

4. The image forming apparatus according to claim 1, wherein the guide member is on a surface of the rear plate, the surface facing the optical box.

5. The image forming apparatus according to claim 1, wherein the substrate is exposed from the optical box and faces the rear plate.

6. The image forming apparatus according to claim 5, wherein the connector protrudes from the substrate toward the rear plate.

7. The image forming apparatus according to claim 1, wherein the connector is arranged on the substrate such that a lengthwise direction of the connector corresponds to a vertical direction.

8. The image forming apparatus according to claim 1, wherein the guide member presses a surface of the flexible flat cable against the rear plate, the surface being opposite to a surface facing the rear plate.

9. The image forming apparatus according to claim 1, wherein the rear plate includes a first wall portion as the wall portion and a second wall portion being adjacent to the first wall portion and facing the side surface, and wherein the flexible flat cable guided by the guide member and arranged along the first wall portion extends to face the second wall portion.

10. The image forming apparatus according to claim 1, wherein the light source includes a first light source configured to emit a first light beam and a second light source configured to emit a second light beam, and wherein the optical box includes a rotary polygon mirror, and the rotary polygon mirror rotates about a rotation axis and deflects the first light beam toward a side of the rotation axis and the second light beam toward an opposite side of the rotation axis, the first light beam and the second light beam entering obliquely with respect to a direction of the rotation axis.

11. The image forming apparatus according to claim 10, wherein the substrate includes a first substrate on which the first light source is situated and a second substrate on which the second light source is situated, wherein the first substrate is arranged next to the second substrate and at a closer position to the side surface than the second substrate is, and wherein the connector is situated only on the first substrate.

* * * * *